US006443215B1

(12) United States Patent
Mason

(10) Patent No.: US 6,443,215 B1
(45) Date of Patent: Sep. 3, 2002

(54) VEHICLE WHEEL MOLD WITH A RETRACTABLE BALL CAP

(75) Inventor: Douglas P. Mason, Livonia, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 0 days.

(21) Appl. No.: 09/474,520

(22) Filed: Dec. 29, 1999

Related U.S. Application Data

(60) Provisional application No. 60/114,563, filed on Dec. 31, 1998.

(51) Int. Cl.[7] ..... B22D 37/00; B22D 33/04

(52) U.S. Cl. ..... 164/133; 164/137; 164/341

(58) Field of Search ..... 164/133, 122, 164/122.1, 125, 137, 360, 359, 351, 346, 341, 340, 339, 296

(56) References Cited

U.S. PATENT DOCUMENTS 3,754,592 A * 8/1973 Mullen ..... 164/60
4,795,125 A * 1/1989 Boros et al. ..... 249/78
4,850,419 A * 7/1989 Blazek ..... 164/122.1
5,311,918 A 5/1994 Scott
5,314,001 A 5/1994 Hidaka et al.
5,320,160 A * 6/1994 Kato et al. ..... 164/305
5,325,907 A 7/1994 Nakabayashi et al.
5,415,464 A 5/1995 Scott
5,427,171 A 6/1995 Prieto
5,647,426 A 7/1997 Prieto et al.
5,896,912 A 4/1999 Monroe et al.

* cited by examiner

*Primary Examiner*—M. Alexandra Elve
*Assistant Examiner*—Len Tran
(74) *Attorney, Agent, or Firm*—MacMillan, Sobanski & Todd, LLC

(57) ABSTRACT

A mold for casting a vehicle wheel includes a movable top core which cooperates with a base member to define a mold cavity. The mold also includes a plurality of movable segments mounted upon the top core. The movable segments define a central gate which communicates with the mold cavity. The central gate receives a charge of molten metal and feeds the charge into the mold cavity. A porous filter is disposed within the gate.

14 Claims, 6 Drawing Sheets

VEHICLE WHEEL MOLD WITH A RETRACTABLE BALL CAP

CROSS REFERENCE TO RELATED APPLICATIONS

This application claims the benefit of U.S. Provisional Application No. 60/114,563, filed on Dec. 31, 1998.

BACKGROUND OF THE INVENTION

The invention relates in general to casting of vehicle wheels and in particular to an improved wheel mold for casting vehicle wheels which has a retractable ball cap.

Vehicle wheels have a circular wheel disc attached to an annular wheel rim. The wheel disc includes a central wheel hub having a pilot hole and plurality of wheel mounting holes formed therethrough. A plurality of equally circumferentially spaced spokes typically support the wheel hub within the wheel rim. The wheel rim is adapted to support a pneumatic tire.

In the past, vehicle wheels typically have been formed entirely from steel. However, wheels formed from light weight metals, such as aluminum, magnesium and titanium or alloys thereof, are becoming increasingly popular. In addition to weighing less than conventional all-steel wheels, such light weight wheels can be manufactured having a pleasing esthetic shape. Weight savings also can be achieved by attaching a wheel disc formed from a light weight metal alloy to a steel wheel rim.

Light weight wheels are typically formed by forging or casting operations. During a casting operation, molten metal is poured into a cavity formed in a multi-piece wheel mold. After the metal cools sufficiently to solidify, the mold is opened and a rough wheel casting is removed. The wheel casting is then machined to a final shape. Machining can include turning the outside and inside surfaces of the wheel rim, facing the inboard and outboard wheel disc surfaces and drilling the center pilot hole and the mounting holes through the wheel hub.

Referring now to the drawings, there is illustrated in FIG. 1 a typical prior art multi-piece wheel mold 10. The mold includes a base member 11 which supports movable left and right side members 13 and 14, respectively. The side members 13 and 14 are moved in a horizontal direction by a conventional mechanism (not shown). A movable cup shaped top core 15 is received by the side members 13 and 14. A ball riser cup 16 having an inverted cup shape is attached to the center of the top core 15. The side members and top core 15 cooperate with the base member 11 to define a mold cavity 20. The mold cavity 20 includes a disc cavity 21 and an annular rim cavity 22. An annular rim riser 23 is formed at the upper end of the rim cavity 22. Similarly, the ball riser cap 16 defines a ball riser 24 in the center of the disc cavity. 21.

The right side member 14 has a gate 30 formed therein. The gate 30 includes an inlet chamber 31 which receives a charge of molten metal. The inlet chamber 31 communicates with an intermediate chamber 32. An axial slot 33 formed in an inside wall of the intermediate chamber 32 communicates with the rim cavity 22.

To cast a wheel, the mold 10 is closed and molten metal poured into the gate 30. The metal flows by gravity into the rim and disc cavities 22 and 21. The molten metal also fills the rim and ball riser cavities 23 and 24, respectively. As the molten metal within the rim and disc cavities 22 and 21 cools and shrinks, gravity urges additional molten metal from the rim and ball riser cavities 23 and 24 and into the rim and disc cavities 22 and 21. This additional metal fills any voids that are formed by shrinkage of the molten metal during cooling and solidification. The metal remaining in the riser cavities 23 and 24 cools to form a center ball riser and an annular rim riser on the casting. Similarly, any metal remaining in the mold gate forms a sprue on the casting. The casting risers and sprue are typically sawed from the casting during the machining operation.

SUMMARY OF THE INVENTION

This invention relates to an improved wheel mold for casting vehicle wheels which has a retractable ball cap.

Prior art wheel molds are charged with molten metal through a side gate. This causes an uneven thermal distribution of heat within the mold. Accordingly, it would be desirable to provide an alternate mold structure for charging the mold which would provide a more uniform thermal distribution of heat within the mold.

The present invention contemplates a mold for casting a component for a vehicle wheel which includes a base member and a movable top core. The top core cooperates with the base member to define a mold cavity. The mold also includes a combined central riser and gate extending axially from the center of the top core. The combined central riser and gate allows gravity charging the center of the mold cavity with molten metal. This results in a uniform thermal distribution of heat within the mold.

It is further contemplated that the combined central riser and gate can include a plurality of movable ball riser cap segments mounted upon the center of the top core. The riser cap segments cooperate to define the gate for charging the mold cavity with molten metal. In the preferred embodiment, a porous filter is disposed in the base of the gate.

Also in the preferred embodiment, each of the riser cap segments has a bore formed therein and each of the bores receives a guide pin. The guide pins are mounted upon the upper surface of the top core base. The guide pins form an angle with the top core and extend in an outward radial direction such that the riser cap segments are movable along the guide pins in an outward radial direction and in an axial direction away from the base of the top core when the riser cap segments are retracted.

Alternately, a plurality of ramps can be formed upon the upper surface of the top core base. The riser cap segments are supported by the ramps and movable along the ramps in an outward radial direction and in an axial direction away from the base of the top core. Additionally, either the ramps can have a guide rail formed thereon with the guide rails being received by corresponding grooves formed in the riser cap segments, or the riser cap segments can have a guide rail formed thereon with the guide rails being received by corresponding grooves formed in the ramps.

The mold can be used to cast a full face wheel disc or a wheel spider. The mold can further include a plurality of movable side members, the mold being used to cast one piece wheels.

The invention further contemplates a method for casting a vehicle wheel component which includes providing a multiple piece mold having a base member and a top core which cooperate to define a mold cavity. The top core carries a plurality of movable ball riser cap segments mounted upon the center thereof. The riser cap segments define a gate for the mold cavity. The mold is closed first and then the ball riser cap segments are closed to form a gate for charging the mold cavity. A charge of molten metal is poured through the gate formed by the riser cap segments and into the mold cavity. The metal is allowed to cool sufficiently to solidify. The ball riser cap segments are retracted first and then the mold is opened. Finally, the casting is removed from the mold. It is further contemplated that the method includes inserting a porous filter between the ball riser cap segments before closing the segments, whereby the charge of molten metal flows through the filter.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
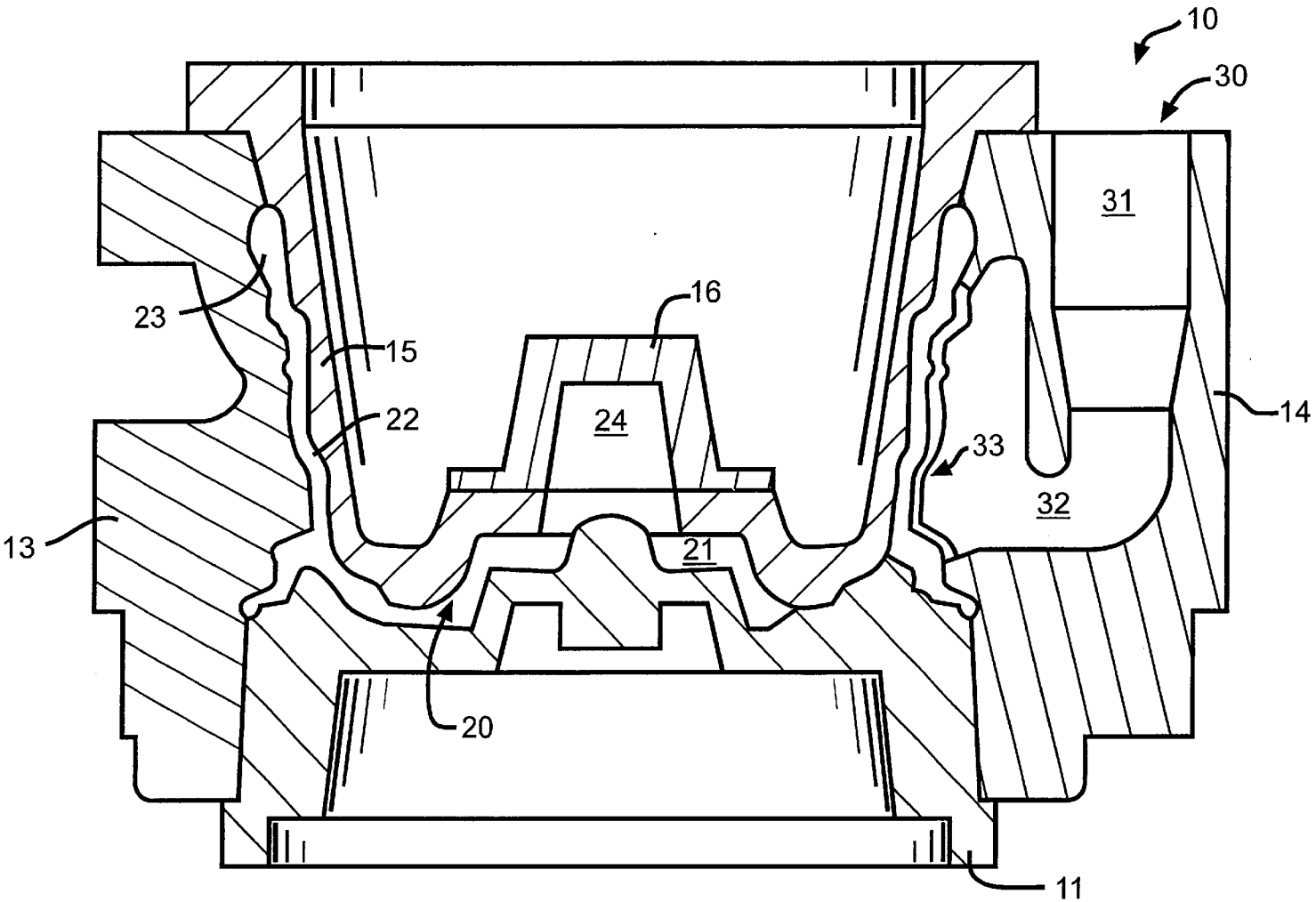
FIG. 1 (PRIOR ART)
FIG. 1 is a sectional view of a prior art multi-piece mold for casting a vehicle wheel.
Figure 2:
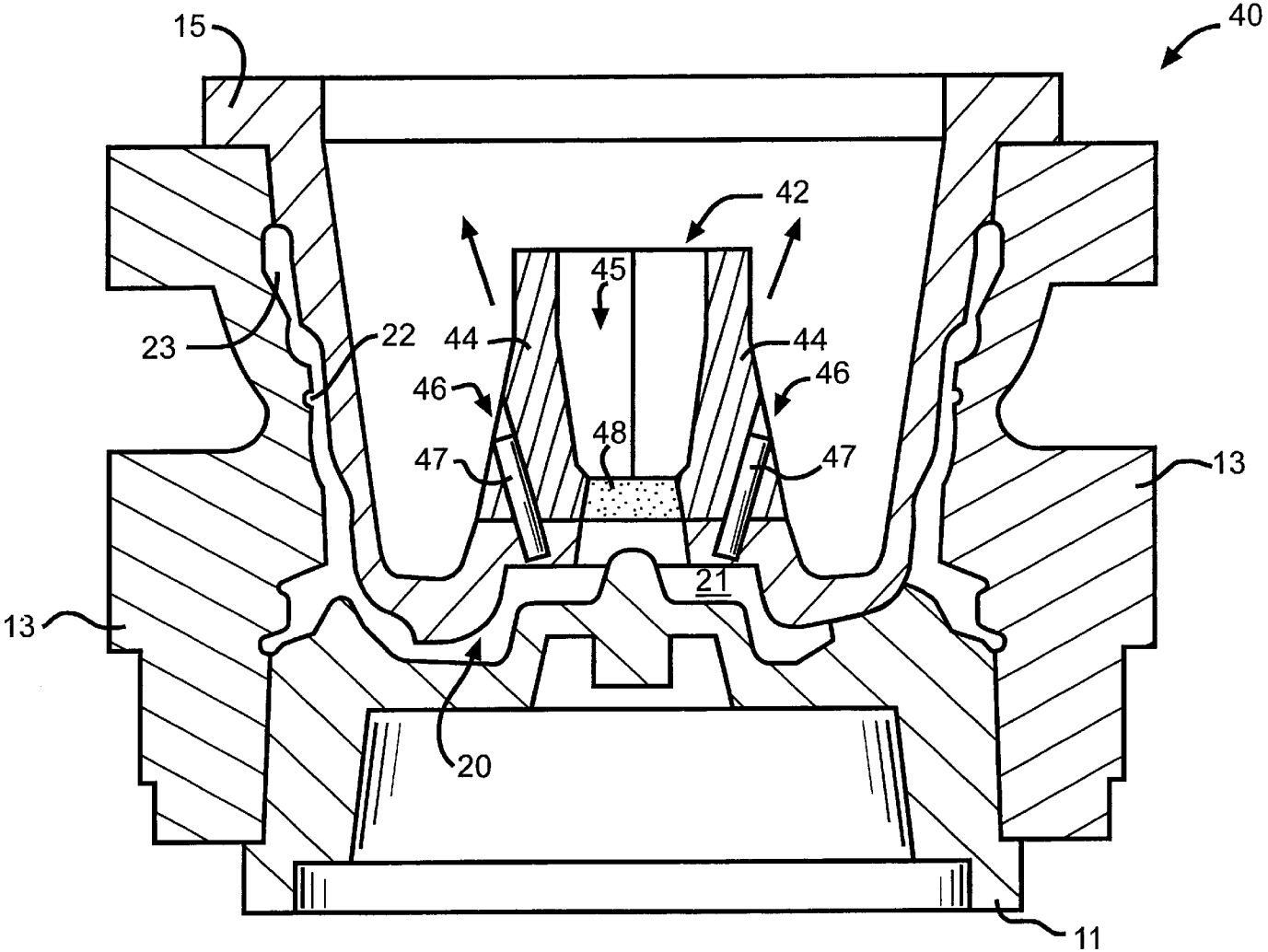
FIG. 2 is a sectional view of an improved multi-piece wheel mold in accordance with the invention.
Figure 3:
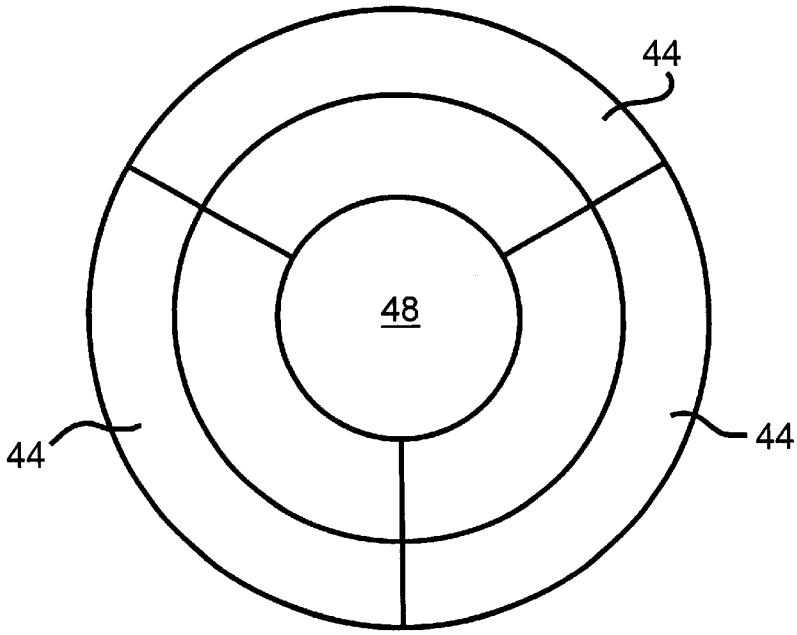
FIG. 3 is a partial plan view of the mold shown in FIG. 2.

Referring again to the drawings, there is illustrated in FIG. 2 an improved multi-piece wheel mold 40 which is in accordance with the invention. Components of the mold 40 which are similar to components of the mold 10 shown in FIG. 1 have the same numerical designators. The mold 40 includes a retractable ball riser cap 42. The ball riser cap 42 includes a plurality of movable segments 44. As shown in FIG. 3, in the preferred embodiment, the cap 42 includes three segments 44; however, the invention also can be practiced with more or less segments. When closed, as shown in FIG. 2, the segments 42 cooperate to define a gate 45 which communicates directly with the center of the disc cavity 20. At least one bore 46 is formed in each of the segments 44. Each bore 46 receives a guide pin 47. The guide pins 47 are mounted upon the base of the top core 15. As shown in FIG. 2, the guide pins 47 extend from the top core base and form an angle therewith such that the pins 47 are canted in a radial outward direction. After the charge of molten metal has solidified, the segments 44 are moved in an outward and upward direction along the guide pins 47 by a mechanism (not shown), as shown by the arrows in FIG. 2, before the top core 15 is raised.

A disposable porous filter 48 formed from a porous material is disposed in base of the gate 45. The filter 48 removes oxides from the molten metal charge while reducing the turbulence of the molten metal charge during the pouring operation. The reduction of turbulence reduces the formation of additional oxides in the molten metal and assures a smooth, tranquil entry of the molten metal into the mold cavity 20. During the casting process, the filter 48 will become a part of a casting ball riser and will be removed from the wheel casting when the ball riser is cut away.

Figure 4:
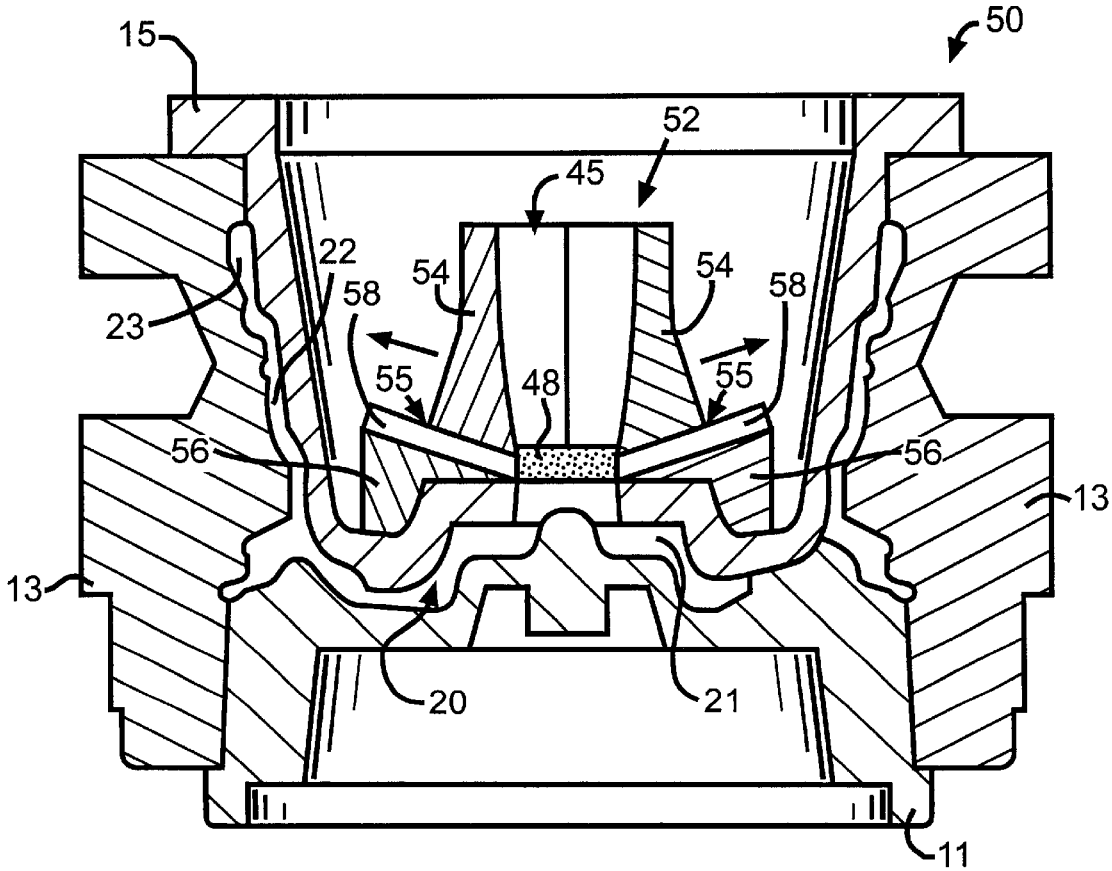
FIG. 4 is a sectional view of an alternate embodiment of the improved mold shown in FIG. 2.

An alternate embodiment of the invention is illustrated generally at 50 in FIG. 4 where components which are similar to components shown in FIG. 2 have the same numerical designators. The mold 50 includes a retractable ball riser cap 52. The ball riser cap 52 includes a plurality of movable segments 54. Each of the segments 54 has at least one generally radially extending groove 55 formed in the base thereof. The segments are carried by complementary ramps 56 which are mounted upon the top surface of the top core base. The ramps 56 have an inclined surface formed thereon which directs the segments 54 in a radial outward and upward direction, as shown by the arrows in FIG. 4, when they are retracted. In the preferred embodiment, each of the ramps 56 has a guide rail 58 formed thereon. The guide rail is received by a corresponding groove 55 and functions to guide the segment 54 as the segment is moved. Alternately, a guide rail (not shown) can be formed upon each of the ball riser cap segments 54. The segment guide rail would be received by a complimentary groove (not shown) formed in the corresponding ramp 56.

Figure 5:
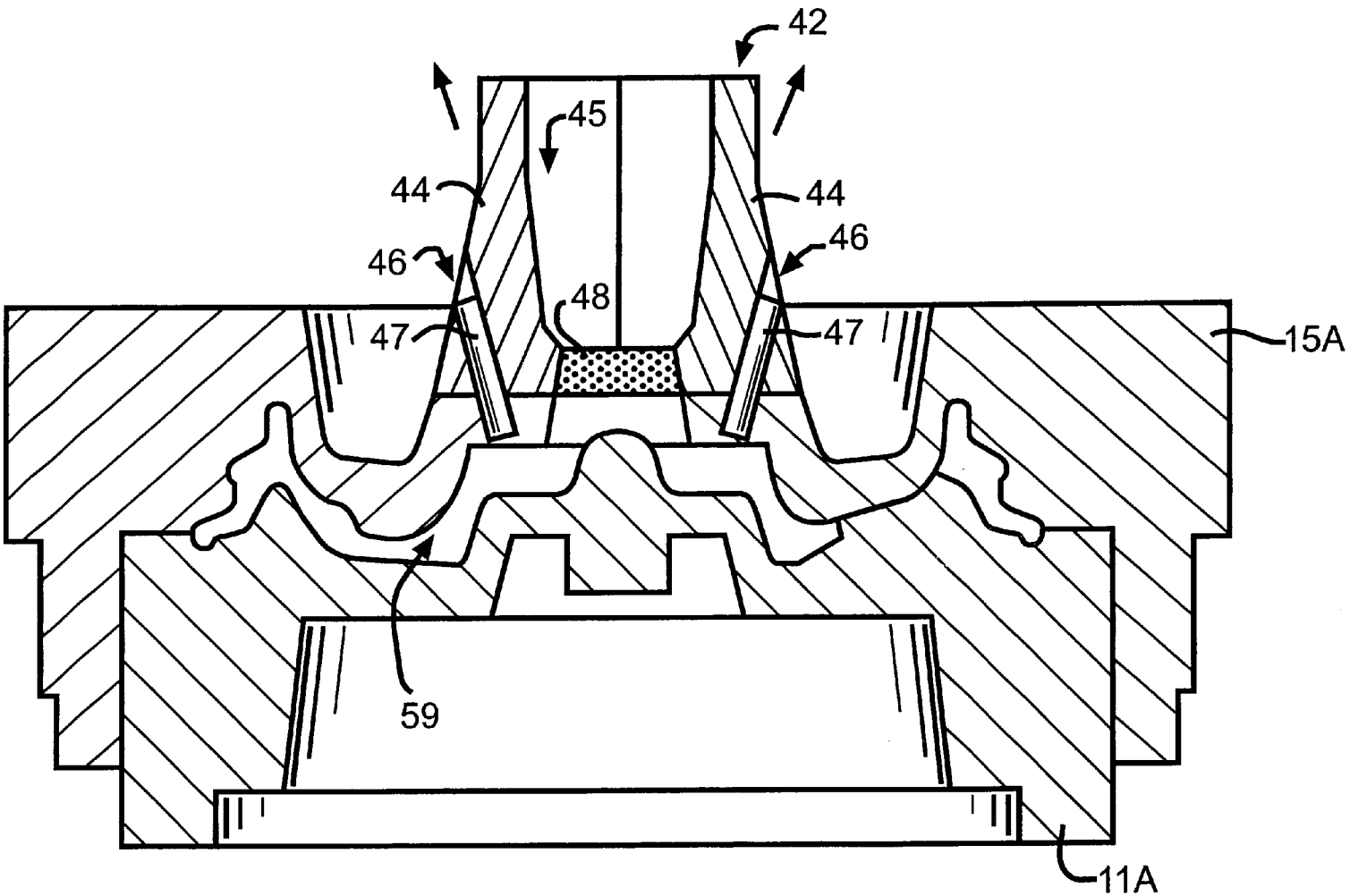
FIG. 5 is a sectional view of another alternate embodiment of the wheel mold shown in FIG. 2.

While the preferred embodiment of the invention has been illustrated and described for a mold for casting a one piece wheel, it will be appreciated that the invention also can be practiced with other molds for forming wheel components. For example, the retractable ball riser cap also can be utilized with molds for casting full face wheel discs or wheel spiders, as illustrated in FIG. 5. Components shown in FIG. 5 which are similar to components shown in preceding figures have the same numerical designators. In FIG. 5, a modified base member 11A and top core 15A cooperate to define a mold cavity 59 for casting a full face wheel disc. The mold shown in FIG. 5 also can be utilized, upon modification of the cavity shape (not shown) to cast wheel spiders.

Figure 6:
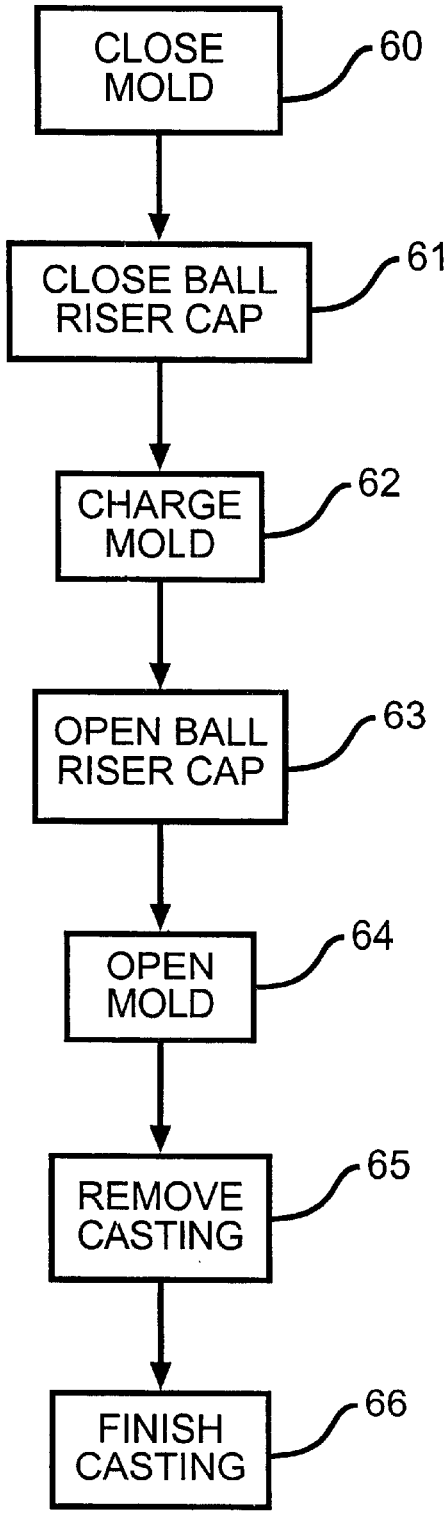
FIG. 6 is a flow chart for a method for casting a wheel which utilizes the mold shown in FIG. 2.

The present invention also contemplates a method for casting a vehicle wheel or vehicle wheel component. The method is illustrated by the flow chart shown in FIG. 6. In functional block 60 a multi piece wheel mold is closed. The mold carries a retractable ball riser cap, as described above, which is closed in functional block 61 after a porous filter is inserted therein. The mold cavity is charged with molten metal through the gate formed in the ball riser cap in functional block 62. The molten metal flows from the gate through the filter and into the mold disc cavity. The molten metal then flows in a radial outward direction from the disc cavity into the rim cavity. Because the metal is introduced into the center of the mold and flows evenly outward to fill the rim cavity, the thermal distribution of heat in the mold is balanced. This provides an improved solidification profile for the casting.

After the metal cools sufficiently to solidify, the ball riser cap segments are retracted in functional block 63 after which the mold is opened in functional block 64. The wheel casting is removed from the mold in functional block 65. The wheel casting is then finished by machining in functional block 66. The finishing also can include optional steps of heat treatment and application of decorative and/or protective coatings.

Figure 7:
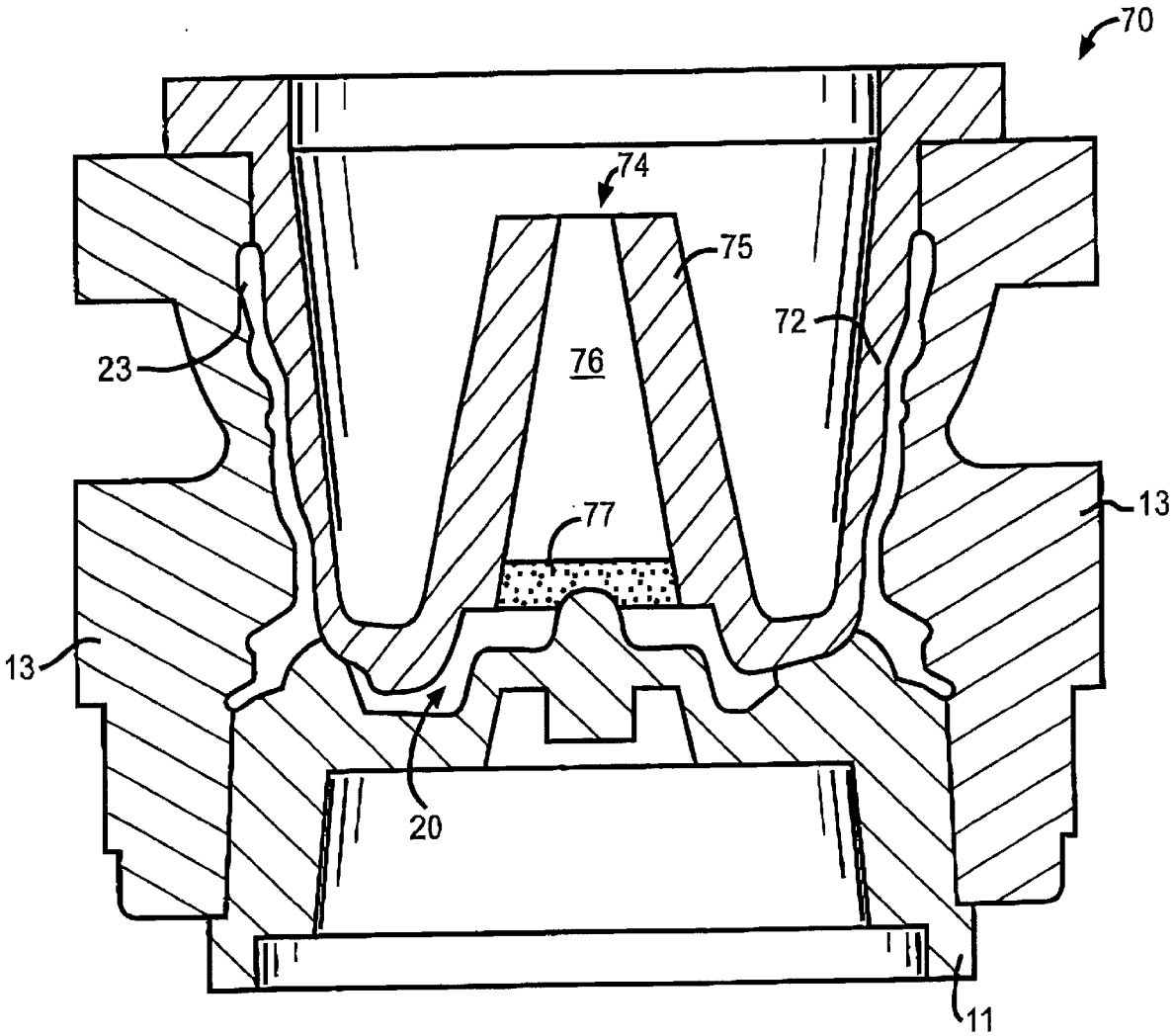
FIG. 7 is a sectional view of another alternate embodiment of the wheel mold shown in FIG. 2.

Another alternate embodiment of the wheel mold is shown generally at 70 in FIG. 7. As before, components shown in FIG. 7 which are similar to components shown in preceding figures have the same numerical designators. The mold 70 includes a top core 72 having a combined gate and wheel disc riser 74 formed therein. The combined gate and wheel disc riser 74 comprises a hollow inverted conical portion 75 which extends from the upper surface of the top core base. The conical portion has a tapped bore 76 extending therethrough which communicates with mold cavity 20. The conical portion 75 has sufficient height to receive a charge of molten metal and allow gravity to urge the metal through the mold cavity 20 and into the rim risers 23. The tapered shape of the bore 76 allows retraction of the top core for removal of the casting. As described above, a porous filter 77 can be positioned within the bore 76. The mold 70 provides the same balanced thermal distribution of heat within the mold during gravity casting operations as described above without the complexity of the movable ball riser segments. While the preferred embodiment of the mold 70 has been illustrated and explained for casting a one piece wheel, it will be appreciated that the mold also can be utilized to cast a wheel component, such as a full face wheel disc or a wheel spider.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope. For example, while the invention has been illustrated and described as having guide pins and ramps to direct the movable ball riser cap segments, it will be appreciated that the invention also can be practiced using other guide structures for the movable segments.

What is claimed is:

1. A mold for casting a component for a vehicle wheel comprising;

a base member;

a movable top core, said top core cooperating with said base member to define a mold cavity; and a plurality of movable ball riser cap segments mounted upon the center of said top core, said riser cap segments cooperating when moved together to form a ball riser cap having a central gate for said mold cavity, said central gate extending in an axial direction from said riser cap, whereby molten metal can be introduced into said mold cavity through said central gate.

2. A mold according to claim 1 further including a plurality of side members, the mold being used to cast a one piece wheel.

3. A mold according to claim 1 wherein the component cast therein is a full face wheel disc.

4. A mold according to claim 1 wherein the component cast therein is a wheel spider.

5. A mold according to claim 1 further including a filter disposed in the base of said gate formed by said riser cap segment.

6. A mold according to claim 1 wherein each of said riser cap segments has a bore formed therein, each of said bores receiving a guide pin mounted upon said top core with each of said riser cap segments being slidable along a corresponding guide pin.

7. A mold for casting a component for a vehicle wheel comprising;

a base member;

a movable top core, said top core cooperating with said base member to define a mold cavity; and a plurality of movable ball riser cap segments mounted upon the center of said top core, each of said bores receiving a guide pin mounted upon said top core, said guide pins forming an angle with said top core and extending in an outward radial direction such that said riser cap segments are movable along said guide pins in an outward radial direction and in an axial direction away from the base of said top core when said riser cap segments are retracted, said riser cap segments cooperating to define a gate for said mold cavity.

8. A mold for casting a component for a vehicle wheel comprising;

a base member;

a movable top core, said top core cooperating with said base member to define a mold cavity;

a plurality of movable ball riser cap segments mounted upon the center of said top core, said riser cap segments cooperating to define a gate for said mold cavity; and a plurality of ramps formed upon said top core, said riser cap segments being supported by said ramps, whereby said riser cap segments are movable along said ramps in an outward radial direction and in an axial direction away from the base of said top core.

9. A mold according to claim 8 wherein said ramps have a guide rail formed thereon, said guide rails being received by corresponding grooves formed in said riser cap segments.

10. A mold according to claim 8 wherein said riser cap segments have a guide rail formed thereon, said guide rails being received by corresponding grooves formed in said ramps.

11. A mold for gravity casting a component for a vehicle wheel comprising;

a base member;

a movable top core, said top core cooperating with said base member to define a mold cavity;

a combination central riser and gate extending axially from the center of said top core, said gate having a tapered bore formed axially therethrough that communicates with said mold cavity, said tapered bore having a first end having a first diameter and a second end having a second diameter, said first end being in communication with said mold cavity and said first end diameter being larger than said second end diameter, whereby molten metal is supplied through said tapered bore to the center of said mold cavity to provide a balanced thermal gradient in the mold while allowing removal of the riser and gate from the component casting after the casting material has solidified; and a porous filter disposed within said tapered bore of said combination central riser and gate.

12. A mold according to claim 11 further including an annular riser formed at the radial outer end of said mold cavity with said riser and gate combination extending axially from said top core beyond said annular riser.

13. A method for casting a vehicle wheel component comprising the steps of:

(a) providing a multiple piece wheel component mold having a base member and a top core which cooperate to define a mold cavity, the top core carrying a plurality of movable ball riser cap segments mounted upon the center thereof, the riser cap segments cooperating when moved together to form a ball riser cap having a central gate for the mold cavity, the central gate extending in an axial direction from the riser cap;

(b) closing the mold;

(c) closing the ball riser cap segments to form the central gate for charging the mold cavity;

(d) pouring a charge of molten metal through the central gate formed by the riser cap segments and into the mold cavity;

(e) allowing the metal to cool sufficiently to solidify;

(f) retracting the ball riser cap segments;

(g) opening the mold; and (h) removing the casting from the mold.

14. A method according to claim 13 further including, during step (c) inserting a porous filter between the ball riser cap segments before closing the segments, whereby the charge of molten metal poured in step (d) flows through the filter.

* * * * *